United States Patent [19]

Whitlock

[11] 4,389,867

[45] Jun. 28, 1983

[54] TOOL FOR RESTORING ROUNDNESS TO METAL TUBING

[75] Inventor: Dellas M. Whitlock, Catlettsburg, Ky.

[73] Assignee: Ashland Oil, Inc., Ashland, Ky.

[21] Appl. No.: 255,014

[22] Filed: Apr. 17, 1981

[51] Int. Cl.[3] ..... B21B 19/12

[52] U.S. Cl. ..... 72/126; 72/121; 72/124

[58] Field of Search ..... 72/110, 111, 121, 124, 72/126, 211, 74, 112, 120, 122, 210, 454; 29/90 R, 282; D8/60

[56] References Cited

U.S. PATENT DOCUMENTS

| | | | |
|---|---|---|---|
| Re. 16,220 | 12/1925 | Mirfield | 72/126 |
| 365,053 | 6/1887 | Daniels | 72/110 |
| 2,813,442 | 11/1957 | Wingate | 72/126 |
| 2,975,819 | 3/1961 | Costanzo et al. | 72/124 |
| 3,078,744 | 2/1963 | Bronstein | 72/124 |
| 3,283,553 | 11/1966 | Taylor | 72/121 |

FOREIGN PATENT DOCUMENTS

| | | | |
|---|---|---|---|
| 1441404 | 5/1966 | France | 72/121 |

*Primary Examiner*—Lowell A. Larson

*Attorney, Agent, or Firm*—Sughrue, Mion, Zinn, Macpeak and Seas

[57] ABSTRACT

A frame bears a pair of laterally spaced lower rollers mounted for rotation about parallel axes within the base of the frame. An upper roller assembly is mounted for movement on the frame towards and away from the lower rollers and bears on the lower face thereof a pair of upper rollers mounted for rotation about parallel axes and positioned to generally overly the lower rollers. A hollow, soft metal tube inserted between the upper and lower rollers and maintained in contact with the rollers by lowering the upper roller assembly has tubing roundness restored during slow rotation of the tube about its axis and longitudinal shifting of the tube between the roller pairs.

7 Claims, 7 Drawing Figures

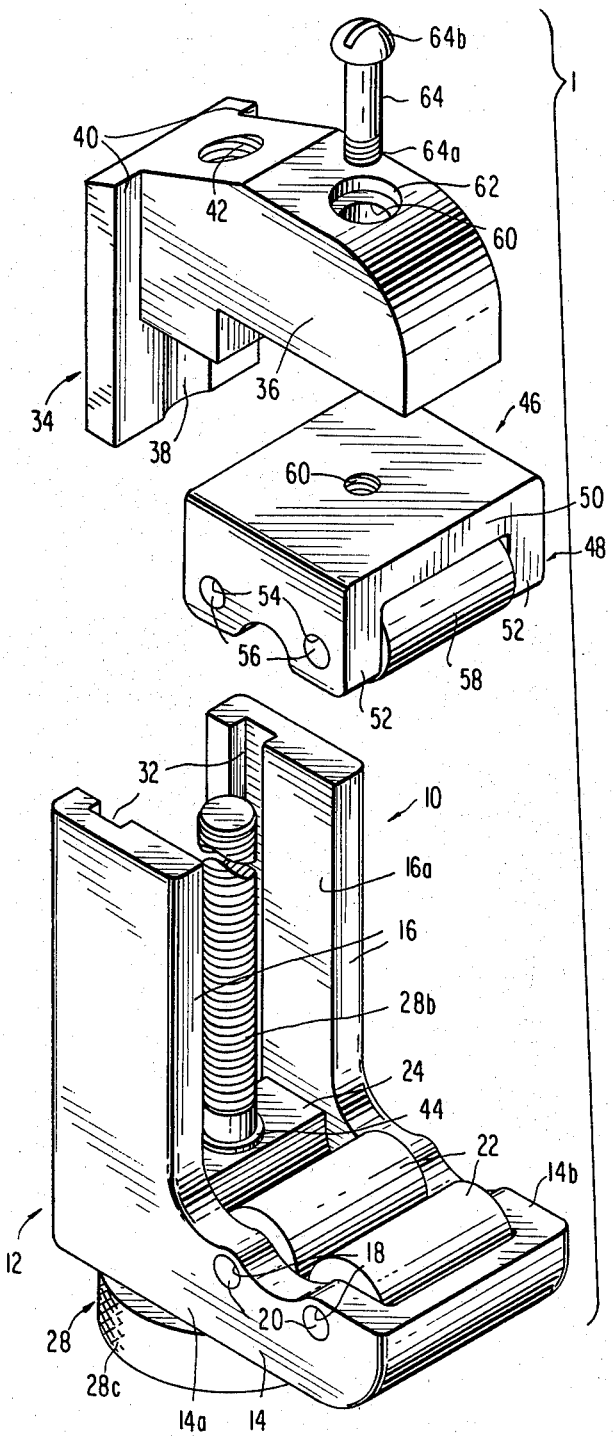
FIG. 1
FIG. 3
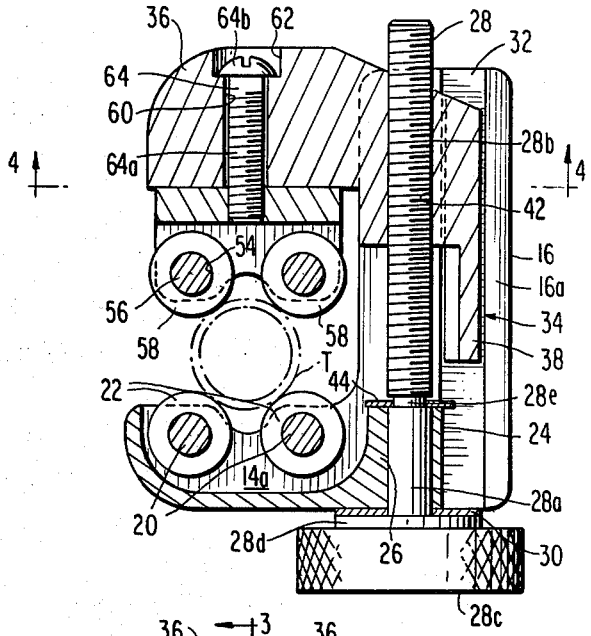
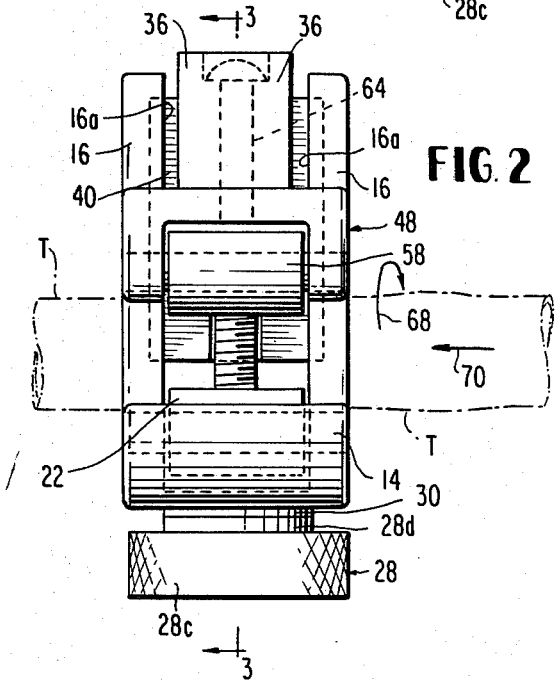
FIG. 2
FIG. 4
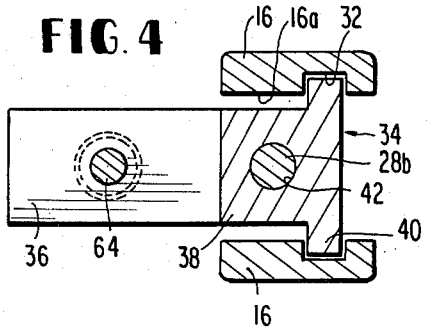

TOOL FOR RESTORING ROUNDNESS TO METAL TUBING

BACKGROUND OF THE INVENTION

This invention relates to a tool for repairing copper or other soft metal tubing and, more particularly, a tool for restoring the roundness to the tubing. This tool is more for the use of reducing copper tube size back to its original diameter than to repair flattened tubing. Copper tubing when frozen swells thereby increasing the diameter to such an extent that the brass or steel fitting will not fit. Better results are obtained on heavier guage tubing.

Soft metal tubing such as that formed of copper has a tendency to become flattened or bulge at localized positions along the tubing which may be detrimental to the strength of the tubing, is unsightly and which may interfere with the flow of liquid or other fluids within the tubing itself. Attempts have been made to repair such copper tubing by attempting to remove such spots. However, such apparatus normally requires the reaming of the tubing interior to remove these spots.

SUMMARY OF THE INVENTION

The present invention is directed to a tool for restoring roundness to tubing, the tool comprising a frame member which may be C-shaped in vertical configuration including an underlying base, a vertical sidewall and an overlying head, and being open to one side to permit sidewise positioning of a soft metal tube between the head and the base. A pair of lower rollers are mounted to the base for rotation, in side by side fashion, about parallel axes at fixed axle positions. An upper roller assembly carried by the frame member bears a pair of upper rollers mounted for rotation about spaced parallel axes in side by side fashion, with the upper rollers generally overlying respective lower rollers. Means are provided for moving the upper roller assembly relative to the lower rollers to vary the spacing between the upper pair of rollers and the lower pair to provide an area between the peripheries of the four rollers within which the soft metal tube may be rotated and shifted axially with the periphery of the tube in contact with respective rollers, whereby, such contact tends to eliminate the flatness and restore roundness to the tubing during slow rotation of the tubing about its axis and axial movement of the tube.

In the form where the frame member is C-shaped with an integral base and head, an adjustment arm is pivotably mounted at one end to the vertical wall bridging the head and base, with the adjustment arm projecting into the opening between the base and the head. The upper roller assembly comprises an inverted U shaped roller holder pivoted to the adjustment arm at the end of the adjustment arm remote from the frame member vertical wall. An adjustment bolt is threadably mounted to the head, and has an end projecting beneath the head in pressing contact with the top of the adjustment arm to thereby press the upper rollers against the periphery of the tube while the tube is supported by the lower rollers.

The adjustment arm may comprise a bifurcated member through which projects an adjustment arm pivot pin fixed to the frame member and centered within the vertical wall. A coil spring may be mounted on the adjustment arm pivot pin and have its ends respectively locked to the frame member and to the adjustment arm and being tensioned so as to tend to raise the adjustment arm and the upper roller assembly away from the lower rollers against the bottom of the adjustment bolt. The upper pair of rollers each may have a different diameter from that of the lower pair of rollers. Preferably, the rollers are spaced laterally from each other to provide equal spaced contact about the periphery of the inserted soft metal tube.

In another form of the invention, the frame member is generally L-shaped including a base bearing the pair of lower rollers and the frame member slidably supports an oppositely directed L-shaped slide including a head overlying base of the frame member. An adjustment screw mounted for rotation about its axis is borne by the base of the frame member and threadably engages the inverted L-shaped slide to cause vertical movement of the slide towards and away from the frame member. The upper roller assembly comprises an inverted U-shaped roller holder locked to the laterally projecting head of the slide and beneath the same, by a machine screw, thereby fixing the upper roller assembly to the slide. The paired rollers for the upper roller assembly and those on the base of the frame member may be of equal diameter, and the roller pairs may be laterally spaced to the same extent.

BRIEF DESCRIPTION OF THE DRAWINGS

FIG. 1 is an exploded perspective view of a tool for restoring roundness to soft metal tubing forming one embodiment of the present invention.

FIG. 2 is a front elevational view of the tool of FIG. 1, with a soft metal tube in place.

FIG. 3 is a vertical sectional view of the tool of FIG. 2, taken about line 3—3.

FIG. 4 is a horizontal sectional view of the tool of FIG. 3, taken about line 4—4.

DESCRIPTION OF THE PREFERRED EMBODIMENTS

Figure 5:
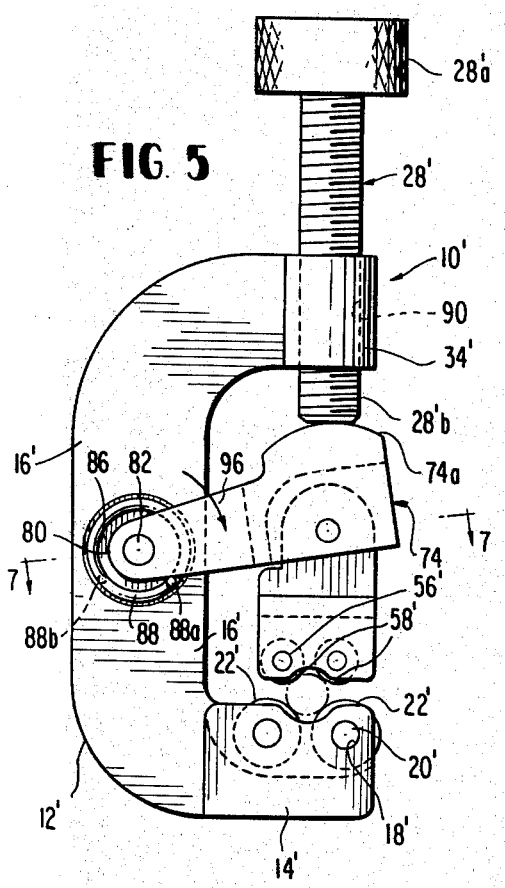
FIG. 5 is a side elevational view of an alternate form of tool for restoring roundness to tubing and forming a second embodiment of the invention.
Figure 6:
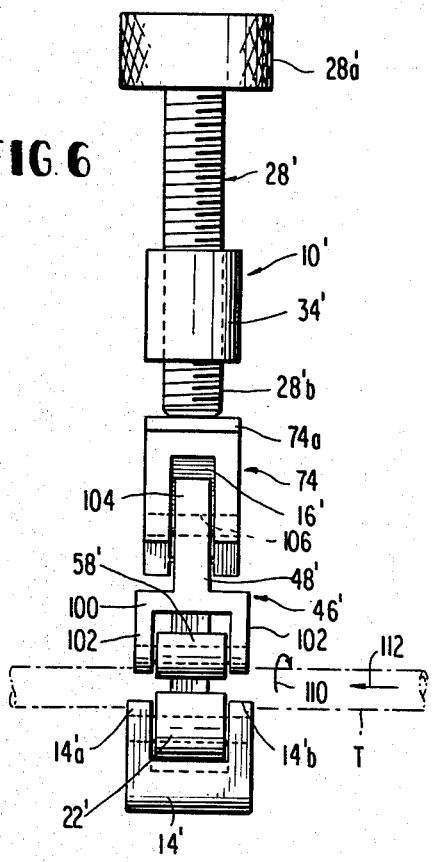
FIG. 6 is a front elevational view thereof.
Figure 7:
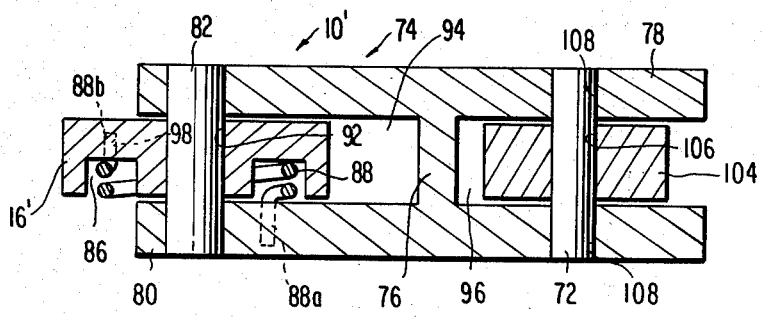
FIG. 7 is a sectional view of the tool illustrated in FIG. 5, taken about line 7—7.

Reference to FIGS. 1 through 4 illustrates one embodiment of the present invention, while FIGS. 5, 6 and 7 show an alternate embodiment. Like elements are given prime numerical designations in FIGS. 5, 6 and 7.

Referring first to the embodiment of FIGS. 1 through 4 inclusive, one form of tool for restoring roundness to tubing is shown and indicated generally at 10 and comprises an L-shaped frame member indicated generally at 12 and being formed of cast metal or the like. Being of L-shaped configuration it is comprised of an integral base 14 and laterally opposed vertical sidewalls 16 with the base 14 including laterally opposed horizontal wall portions **14*a*, 14*b*. The frame member has a hollow or open interior. Each of the wall portions 14*a* and 14*b* is provided with horizontally spaced holes 18 forming journals for roller mounting pins 20; the pins 20 rotating about horizontal, parallel and spaced axes defined by the pins 20. The pins 20 project from the ends of a pair of lower rollers as at 22, which rollers have a length slightly less than the distance between wall portions 14*a* of base 14, and the diameter of rollers 22** is such that the rollers are spaced horizontally from each other.

The frame member 12 is additionally provided with a transverse block 24 spanning between the lateral sidewalls 16, the block 24 including a vertical hole 26 of given diameter through which projects the unthreaded portion 28*a* of an adjustment bolt indicated generally at 28. Bolt 28 terminates at its upper end in a threaded portion 28*b*, while at its lower end, the bolt is provided with an enlarged diameter knurled portion or adjustment knob 28*c*. Portion 28*d*, adjacent knob 28*c* is of somewhat reduced diameter from that of knob 28*c* but is much larger than the unthreaded portion 28*a*, forming a shoulder upon which is positioned a washer 30, the washer 30 being positioned intermediate of the adjustment bolt 28 and the frame member base 14.

Further, each of the frame member sidewalls 16 are provided on their inside surfaces 16*a*, which face each other, with elongated vertical guide grooves 32, offset from the projecting adjustment bolt threaded portion 28*b*. Mounted for sliding movement on the frame member 12 is an inverted L-shaped slide or slide member indicated generally at 34 and comprised of a horizontal, right angle projecting head 36 and a vertical rear wall 38 bearing rails or tracks 40 to each side thereof; the rails 40 being of a width slightly less than the width of the vertical guide grooves 32, within which grooves 32, the rails 40 of slide member are positioned. The head 36 is provided with a tapped and threaded hole as at 42 which receives the threaded end 28*b* of the adjustment bolt 28. The adjustment bolt 28 is further provided with a reduced diameter portion or peripheral groove 28*e* which is aligned with the top of block 24 when the adjustment bolt 28 is positioned within hole 26 of the frame member base 14. A snap ring 44 snaps into the groove 28*e* of the adjustment bolt 28 to lock the adjustment bolt 28 to the frame member but permit the rotation of the adjustment bolt 28 about its axis. As the adjustment bolt 28 rotates, it threadably raises and lowers the slide member 34 on the rails 40, guided by the guide slots 32 within opposed faces 16*a* of the frame member vertical walls 16.

An upper roller assembly indicated generally at 46 completes the tool. The assembly 48 is comprised of an inverted U-shaped roller holder indicated generally at 48, comprised of base 50 and opposed lateral sidewalls or arms 52. The sidewalls or arms 52 of the inverted U-shaped roller holder 48, are provided with paired holes 54 at horizontally opposed positions within which are rotatably positioned roller mounting pins 56, the pins 56 being fixed to and projecting from opposite ends of paired upper rollers 58 mounted for side by side rotation within the opposed sidewalls or arms 52 of the roller holder. The lateral gap between the sidewalls 52 is slightly larger than the axial length of rollers 58. The pins 56 match pins 18 for the lower rollers 22 and the rollers 22 and 58 are identically sized as may be seen by reference to FIG. 3.

Further, the head 36 is provided with a vertical hole as at 60 which is counterbored at 62 from the top of the head. A machine screw 64 is inserted from the top of the head into the bore 60 such that its threaded lower end 64*a* projects from the bottom of hole 60, while the head 64*b* of the machine screw 64 is received within counterbore portion 62. By use of a screwdriver or the like, the machine screw 64 is screwed into base 50 of the roller holder. The base 50 is provided with a tapped and threaded hole 66 at its center, receiving the end 64*a* of screw 64. Thus, the roller holder is fixedly mounted to the bottom of the head 36 of the inverted L-shaped slide member 34.

With the rollers the paired of rollers 58 spaced somewhat above the lower rollers 22 and in line therewith, the tool is ready for the insertion of a soft metal, i. e., malleable, tube as at T, FIGS. 2 and 3. When the tube T is positioned such that it lies on top of the lower rollers 22, the adjustment knob is rotated about its axis to bring the head 36 downwardly and to cause the upper rollers 58 to move into contact with the outer periphery of the tube T. Then, as seen in FIG. 2, tube T is rotated about its axis as indicated by arrow 68, and is moved axially, i. e. through the assembly of upper and lower rollers, as indicated by arrow 70, thereby causing a localized out of roundness as at R to be corrected. Contact with the rollers forces the outer periphery of the tube T to take its original form, removing any projections, flatness or the like.

Referring next to FIGS. 5, 6 and 7, in the second embodiment, the tool, indicated generally at 10', is comprised principally of a C-shaped frame member 12' in which a head 34' is integrated to the base 14', with the head 34' overlying the base 14' and forming a side opening for the frame member 12'. The frame member 12' includes a single vertical wall as at 16' which integrally connects the head 34' to base 14'. The base 14' comprises a pair of vertical upstanding sidewalls as at 14'*a*, 14'*b* and spanning between these base sidewalls 14'*a* 14'*b* are the a pair of lower rollers at 22' mounted for rotation about their axes by way of roller mounting pins 20' which project through holes 28' within the base sidewalls 14'*a*, 14'*b*. The rollers 22' and their spacing are identical to that of the first embodiment. However, in contrast to the first embodiment, the adjustment bolt indicated generally at 28' is not mounted to the base 14' but is mounted to head 34'. The adjustment bolt 28' comprises a knurled adjustment knob 28'*c* from which projects a threaded shaft portion as at 28'*b* which is threaded into a tapped and threaded hole 90 within the fixed head 34'.

The nature and mounting of an upper roller assembly as at 46' is substantially different from that of the first embodiment.

As may be seen in FIG. 7, the rear vertical wall 16' bears a hole as at 92 through which projects an adjustment arm pivot pin 82, being fixed to the vertical wall 16' and having ends projecting laterally outwardly of that member. The tool comprises an adjustment arm indicated generally at 74 which includes a central web 76 and bears oppositely directed slots or openings as at 94, 96, formed by spaced parallel walls as at 78 which open to the right, FIGS. 5 and 7, and corresponding walls 80 which open to the left and which straddle the vertical wall 16'. Thus, the adjustment arm 74 is mounted for pivoting about a horizontal axis as defined by pin 82, the adjustment arm 74 rotating as indicated by arrow 96, FIG. 5, about the axis of the adjustment arm mounting pin 82. Further, the vertical wall 16' bears on one side, an annular recess 86, i.e. a circular groove, within which is seated a tensioning coil spring 88, the spring 88 being wound and having one end 88*a* abutting the lower side of adjustment arm 74, while its opposite end 88*b* projects into a small hole as at 98 within the bottom of the annular recess 86.

As may be appreciated, the spring 88 tends to bias the adjustment arm 74 for rotation in a counterclockwise direction, FIG. 5, tending to maintain an upper face 74*a* against the bottom of the adjustment bolt 28'.

Within slot 96 of the adjustment arm 74, and between lateral walls 78, there is rotatably mounted an upper roller assembly indicated generally at 46', principally formed of an upper roller holder 48', being of generally inverted U-shaped configuration including a base portion 100, opposed lateral walls 102 and having rising integrally from the center of base 100, a right angle mounting plate 104. The plate 104 is provided with a circular opening 106 passing through the center of the same through which projects a mounting pin 72, the pin 72 passing through aligned holes 108 within the lateral sidewalls 78 of the adjustment arm member 74. Pin 72 is fixed to the adjustment arm 74. However, the roller holder 48' is free to pivot about the axis of pin 72 to maintain the lower rollers 58' generally horizontal regardless of the raised or lowered position of the adjustment arm member 74 as it pivots as indicated by arrow 96 about a mounting axis defined by mounting pin 82 fixedly carried by the vertical wall 16' of the frame member 12'. The mounting pins 56' for the upper rollers 58' project to each side of the upper rollers and are rotatably mounted within the holes 56', 54' within the opposed sidewalls 102 of the bifurcated roller holder 48'.

As may be appreciated, the set up and operation of the tool 10' of FIGS. 5, 6 and 7 is essentially the same as that of tool 10 forming the first embodiment illustrated in FIGS. 1 through 4 inclusive. In that respect, the adjustment bolt 28' is rotated so that the tensioning coil spring 88 rotates the adjustment arm member 74 upwardly and thus the upper rollers 58' away from the lower rollers 22'. It is noted that in this embodiment the upper rollers are of smaller diameter than the lower rollers 22'. Rotation of the adjustment bolt ceases when the gap between the upper and lower rollers is sufficiently large to permit the tube T, FIG. 6, to be inserted between the rollers with, the tube T resting on the periphery of lower rollers 22'. The adjustment knob 28' is then rotated in the opposite direction, causing the adjustment bolt to press downwardly against the upper face 74*a* of the adjustment arm member 74, driving this member clockwise against the bias of tensioning coil spring 88. Rotation continues until the tube T is contacted by the periphery of upper rollers 58'. At this point, rotation is given to the tube T, FIG. 6, as indicated by arrow 110, while the tube T is moved axially as indicated by the arrow 112. In this manner, the tube is relieved of any of its out of roundness, flat spots or the like in the manner described previously, in conjunction with the first embodiment of the invention.

As may be appreciated, the parts making up the tool may be formed of cast or forged metal, such as steel, or the like.

The upper and lower rollers may all be of equal diameter or may be of different diameters, as indicated in the second embodiment. Further, the spacing between the the upper rollers may be the same or identical to that between the lower rollers, or different spacings may be employed.

It is, however necessary, that in order to insure that the tube T is completely restored to roundness, the opposed sets of upper and lower rollers are employed in the manner of the illustrated embodiments.

While the invention has been particularly shown and described with reference to preferred embodiments thereof, it will be understood by those skilled in the art that the foregoing and various other changes in form and details may be made therein without department from the spirit and scope of the invention.

What is claimed is:

1. A tool for restoring roundness to soft metal tubing, said tool comprising:

a frame member, said frame member including at least an underlying, horizontal base and a vertical sidewall, a head overlying said base, said tool being open to one side to permit sidewise positioning of a soft metal tube between said head and said base, a pair of lower rollers mounted to said base for rotation about parallel, horizontal axes, in side by side fashion at fixed axle positions, an upper roller assembly movably mounted to said frame member, overlying said base and bearing a pair of rollers mounted for rotation about spaced, parallel horizontal axes, in side by side fashion, and at fixed axle positions on said upper roller assembly, with said upper rollers generally overlying respective lower rollers, and means for threadably driving said upper roller assembly downwardly relative to said lower rollers to effect positive drive spacing between the upper and lower pairs of rollers with the peripheries of all four rollers in light contact with the periphery of said tube after tubular insertion into the opening such that rotation of said tube about its axis and shifting of said tube axially causes said tool to restore roundness of said tube by local deformation at areas of tube out of roundness or flatness.

2. The tool as claimed in claim 1, wherein said frame member is C-shaped and integrally includes said base, said vertical sidewall and said head, an adjustment arm is pivotably mounted at one end to said vertical sidewall with said adjustment arm projecting into the opening between said base and said head, said upper roller assembly comprises an inverted U-shaped roller holder pivoted to the end of said adjustment arm remote from that end pivoted to said frame member vertical sidewall, and wherein an adjustment bolt is threadably mounted to said head and has an end projecting from beneath said head in pressing contact with the top of said adjustment arm to thereby press said upper rollers against the periphery of said tube while said tube is supported by said lower rollers.

3. The tool as claimed in claim 2, wherein said adjustment arm comprises a bifurcated member through which projects an adjustment arm pivot pin, said pin being fixed to said frame member and centered within said vertical sidewall, a coil spring mounted on said adjustment arm pivot pin and having one end locked to said frame member and the other end to said adjustment arm and being tensioned so as to raise said adjustment arm and said upper roller assembly away from said lower rollers, against the bottom of said adjustment bolt.

4. The tool as claimed in claim 1, wherein said upper pair of rollers have equal diameters but of a different diameter from those of said pair of lower rollers.

5. The tool as claimed in claim 4, wherein said rollers of said respective pairs are spaced laterally from each other to provide equal spaced circumferential contact about the periphery of said inserted soft metal tube on opposite sides thereof.

6. The tool as claimed in claim 1, wherein said frame member is generally L-shaped and wherein said frame member slidably supports an oppositely directed L-shaped slide which includes integrally said head and wherein said tool further comprises an adjustment screw borne by said base of said frame member, mounted for rotation about its axis and threadably engaging said inverted L-shaped slide to cause, when said adjustment screw in rotated about its axis, vertical movement of said slide towards and away from said frame member, and wherein said upper roller assembly comprises an inverted U-shaped roller holder fixidly mounted to the bottom of said laterally projecting head of said slide.

7. The tool as claimed in claim 6, wherein said upper pair of rollers and said lower pair of rollers are of equal diameter and wherein said rollers of said pairs are laterally spaced to the same extent.

* * * * *